US007342205B2

(12) United States Patent
Wilkins et al.

(10) Patent No.: US 7,342,205 B2
(45) Date of Patent: Mar. 11, 2008

(54) APPARATUS AND METHOD FOR CONTROLLING AN ELECTRIC HEATING ASSEMBLY

(75) Inventors: Peter Ravenscroft Wilkins, Droitwich (GB); Kevin Ronald McWilliams, Stratford upon Avon (GB)

(73) Assignee: Ceramaspeed Limited (GB)

( * ) Notice: Subject to any disclaimer, the term of this patent is extended or adjusted under 35 U.S.C. 154(b) by 280 days.

(21) Appl. No.: 10/500,993

(22) PCT Filed: Jan. 16, 2003

(86) PCT No.: PCT/GB03/00172

§ 371 (c)(1),
(2), (4) Date: Jan. 24, 2005

(87) PCT Pub. No.: WO03/063551

PCT Pub. Date: Jul. 31, 2003

(65) Prior Publication Data

US 2006/0213901 A1 Sep. 28, 2006

(30) Foreign Application Priority Data

Jan. 16, 2002 (GB) ..... 0200914.0

(51) Int. Cl.
*H05B 3/68* (2006.01)
*H05B 1/02* (2006.01)

(52) U.S. Cl. ..... 219/460.1; 219/490

(58) Field of Classification Search .. 219/443.1–468.2, 219/476–517

See application file for complete search history.

(56) References Cited

U.S. PATENT DOCUMENTS

| | | | | |
|---|---|---|---|---|
| 4,347,432 | A * | 8/1982 | Gossler | 219/448.19 |
| 4,410,795 | A * | 10/1983 | Ueda | 219/492 |
| 5,293,028 | A | 3/1994 | Payne | |
| 5,961,867 | A * | 10/1999 | McWilliams | 219/446.1 |
| 6,018,149 | A * | 1/2000 | Higgins | 219/462.1 |

FOREIGN PATENT DOCUMENTS

| | | |
|---|---|---|
| DE | 29923976 | 12/1999 |
| EP | 0886459 | 12/1998 |

OTHER PUBLICATIONS

International Search Report Jul. 1, 2003.

* cited by examiner

*Primary Examiner*—Sang Paik
(74) *Attorney, Agent, or Firm*—Ira S. Dorman

(57) ABSTRACT

In apparatus and a method for providing electronic control of an electric heating assembly, a radiant electric heater (10, 110) is arranged at a lower surface (22, 124) of a glass-ceramic cooking plate (12, 112), the plate having an upper surface (40, 138) for receiving a cooking vessel (42, 136A, 136B). A temperature sensor (24, 140) monitors temperature at or adjacent to the cooking plate (12, 112) and provides an electrical output as a function of temperature. Control means (30, 142) connected to the temperature sensor (24, 140) and to the heater (10, 110) controls energising of the heater from a power supply (28, 134) for energising the heater at a plurality of user selectable power levels including a full power level. When the heater (10, 110) is energised at the full power level it is energised to heat the cooking plate (12, 112) to a first temperature level during a predetermined initial period (A) of 20 to 50 minutes and is thereafter (C) energised to heat the cooking plate to a second temperature level, lower than the first temperature level.

22 Claims, 6 Drawing Sheets

FIG 1
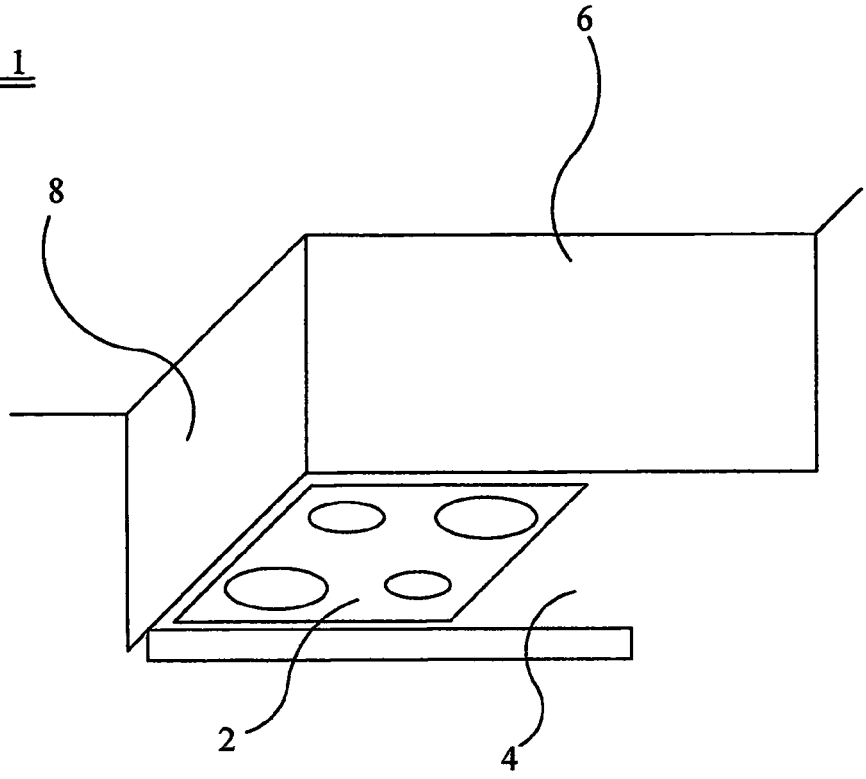
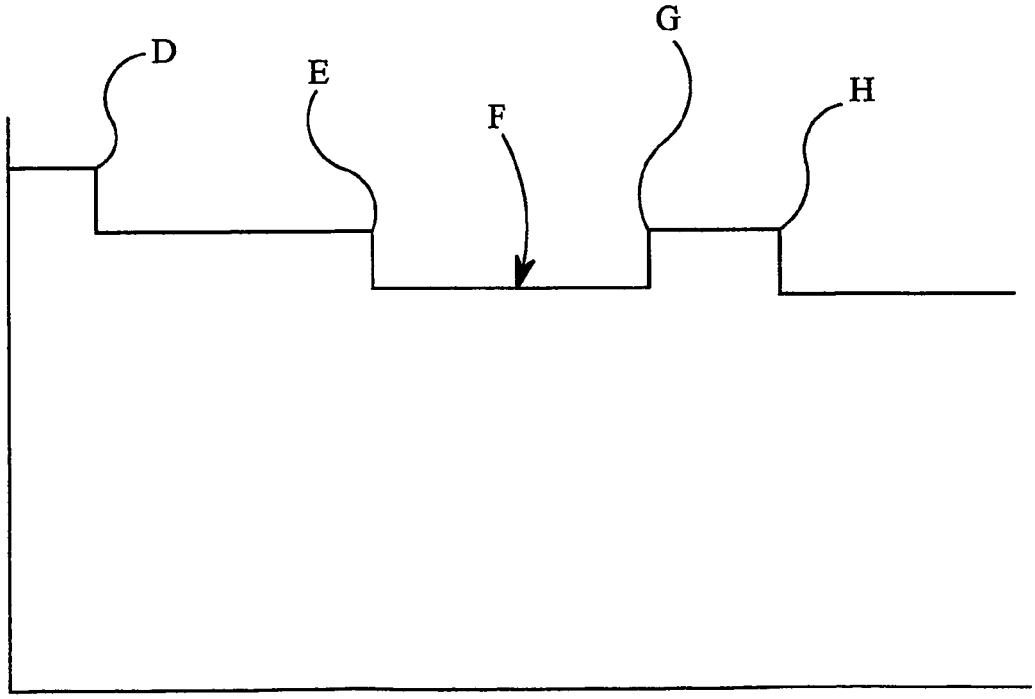
FIG 5

FIG 2
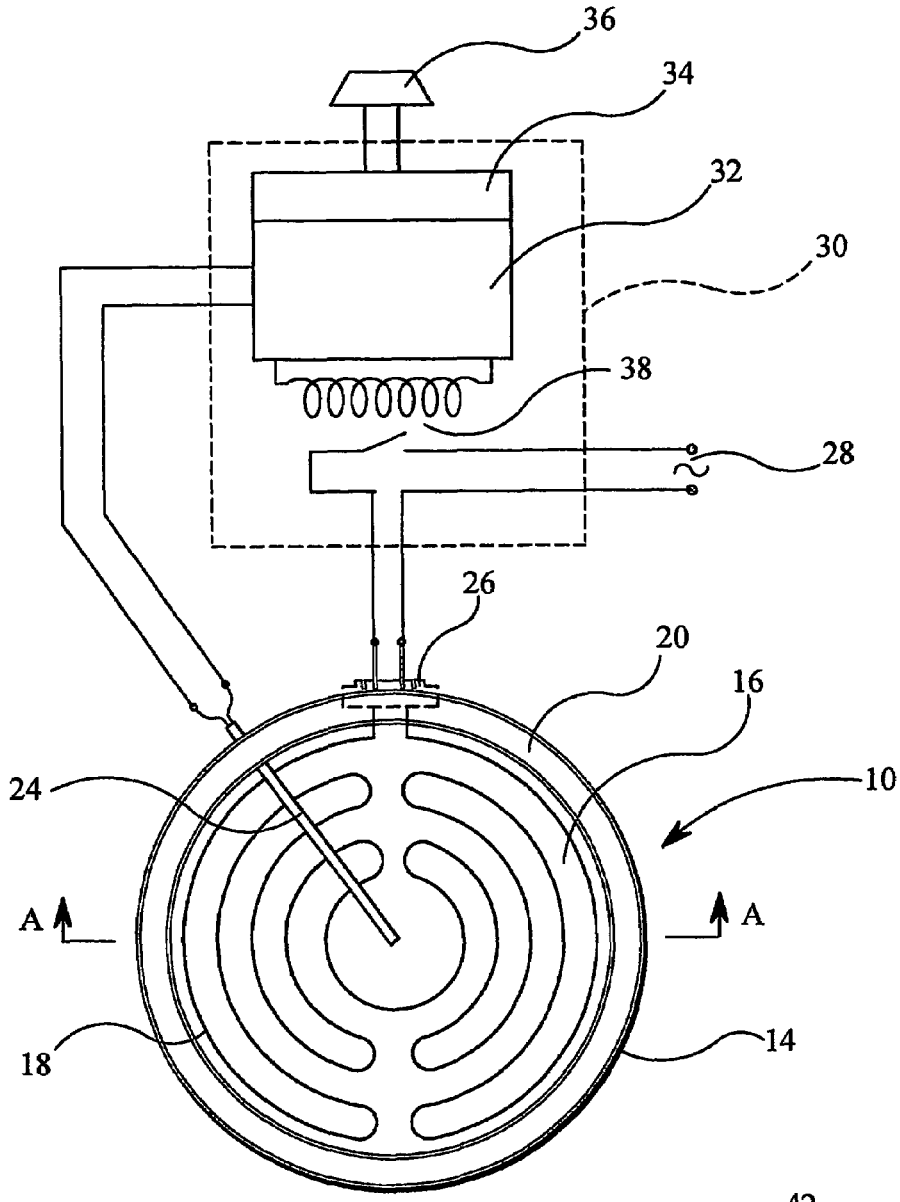
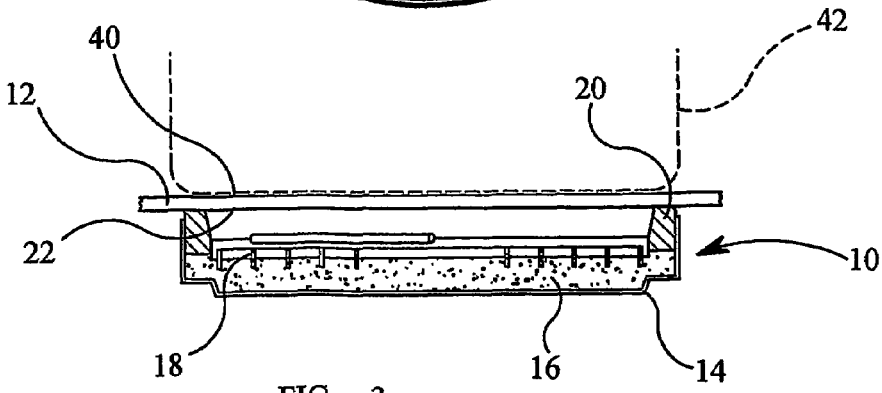
FIG 3

FIG 6
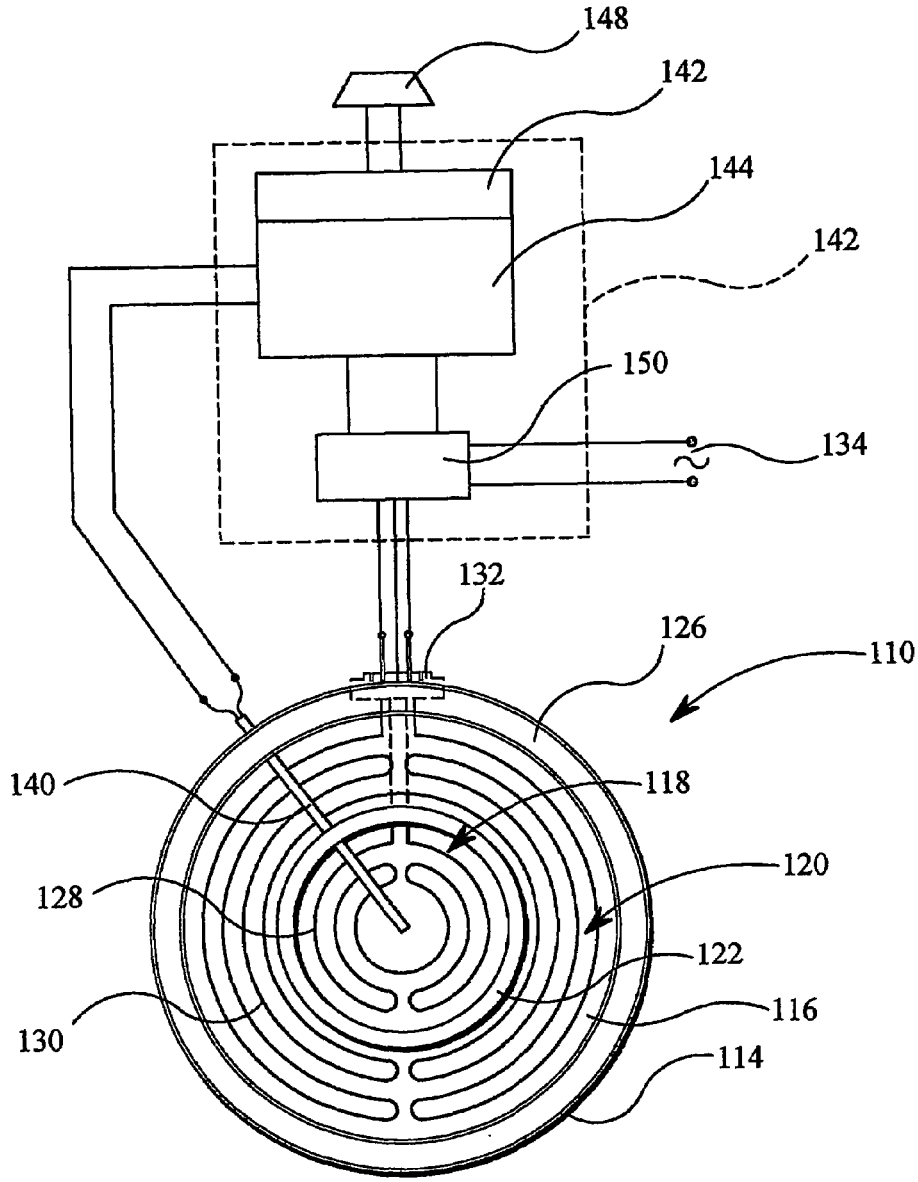
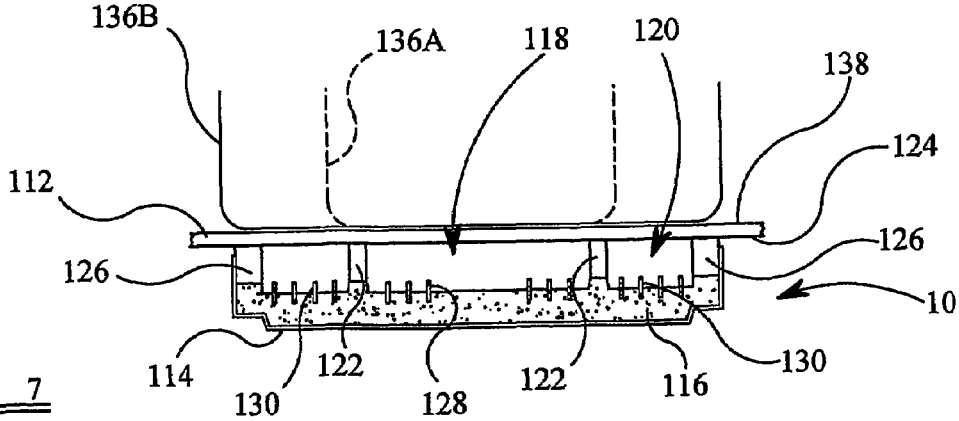
FIG 7

FIG 9
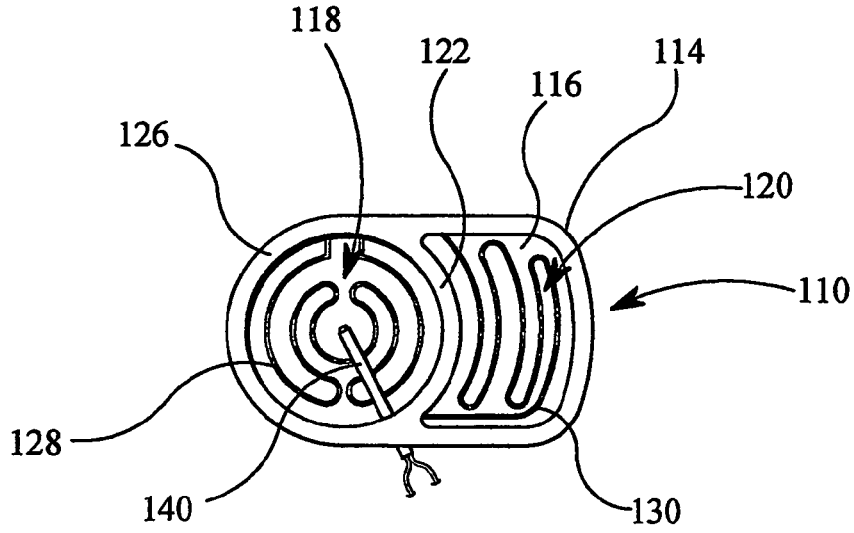
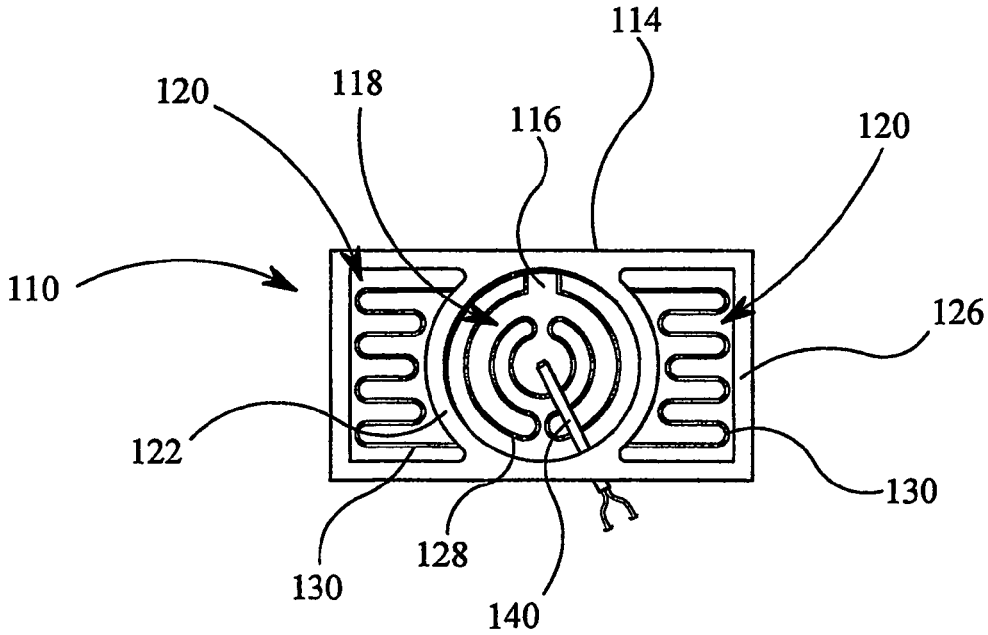
FIG 10

APPARATUS AND METHOD FOR CONTROLLING AN ELECTRIC HEATING ASSEMBLY

This invention relates to an apparatus and a method for controlling an electric heating assembly in which a radiant electric heater is arranged beneath a glass-ceramic cooking plate in a cooking appliance.

When a radiant electric heater is operating beneath a glass-ceramic cooking plate, in order to heat a cooking vessel located on an upper surface of the cooking plate, the lower surface of the cooking plate is heated by direct radiation from the heater and heat is transferred through the cooking plate to the cooking vessel on the upper surface. In free radiation conditions, that is without any cooking vessel on the cooking plate, the radiant heaters in a glass-ceramic cooktop appliance will transmit heat to a back wall, for example a wall of a kitchen, and to any side wall adjacent to the cooktop. Temperature limits for the back wall and any side walls are specified in European Safety Standard EN60335.

Further, in order to prevent thermal damage occurring to the cooking plate, the temperature, particularly of the lower surface, must be controlled. In order to control the temperature of the lower surface of the glass-ceramic cooking plate, temperature limiters are provided in heaters to de-energise the heaters at a predetermined temperature. Such limiters, which have generally been of electro-mechanical construction, are set to respond to the temperature of the upper surface of the cooking plate.

As a precaution, in order to meet the various requirements of the glass-ceramic cooktop and appropriate safety standards, the temperature limiter is generally set to switch, in free radiation conditions, at a relatively low temperature of the upper surface (commonly referred to as top glass temperature), which may be less than 550 degrees Celsius. Such an arrangement is unsatisfactory as it means that the rate of heat transfer, particularly to cooking vessels having less than ideal contact with the upper surface of the cooking plate, is reduced by premature switching of the limiter, making it impossible to make maximum and optimum use of the available power of the heaters.

It is known from EP-A-0 886 459 to provide an initial temperature boost such that the temperature of a glass ceramic cooking plate exceeds a predetermined continuous safe level. This is balanced by subsequently reducing the temperature such that in the longer term the continuous safe temperature is not exceeded. The initial boost is relatively short, about 10 minutes, and the subsequent temperature reduction is to preserve the life of the glass ceramic cooktop, not to satisfy back wall and side wall temperature requirements.

It is an object of the present invention to overcome or minimise the above problem.

According to one aspect of the present invention there is provided apparatus for providing electronic control of an electric heating assembly in which a radiant electric heater is arranged at a lower surface of a glass-ceramic cooking plate, the cooking plate having an upper surface for receiving a cooking vessel, the apparatus comprising: a temperature sensor for monitoring temperature at or adjacent to the cooking plate, which sensor provides an electrical output as a function of temperature; and control means connected to the temperature sensor and to the heater, for controlling energising of the heater from a power supply, the control means being adapted and arranged to energise the heater at a plurality of user selectable power levels including a full power level, wherein when the heater is energised at the full power level it is energised to heat the cooking plate to a first temperature level for a predetermined initial period of 20 to 50 minutes and is thereafter energised at a second temperature level, lower than the first temperature level.

According to a further aspect of the present invention there is provided a method of providing electronic control of an electric heating assembly in which a radiant electric heater is arranged at a lower surface of a glass-ceramic cooking plate, the cooking plate having an upper surface for receiving a cooking vessel, the method comprising: providing a temperature sensor for monitoring temperature at or adjacent to the cooking plate, which sensor provides an electrical output as a function of temperature; and providing control means connected to the temperature sensor and to the heater, for controlling energising of the heater from a power supply, the control means being adapted and arranged to energise the heater at a plurality of user selectable power levels including a full power level, wherein when the heater is energised at the full power level it is energised to heat the cooking plate to a first temperature level during a predetermined initial period of 20 to 50 minutes and is thereafter energised at a second temperature level, lower than the first temperature level.

During an initial minor proportion of the predetermined initial period the heater may be energised at a boost power level, in excess of the first power level.

The second temperature level may be between about 75 percent and about 85 percent, preferably about 83 percent, of the first temperature level.

The length of the predetermined initial period may be dependent on the time elapsed since the control means was last at full power. The length of the predetermined initial period may be inversely proportional to the time elapsed since the control means was last at the full power level.

Reduction from the first temperature level to the second temperature level may be effected in a continuous or stepwise manner. If stepwise it may be effected in a single step or in a plurality of steps.

The control means may comprise a microprocessor-based controller into which the predetermined initial period and a setting for the second temperature level are permanently programmed for automatic implementation.

The temperature sensor may provide an electrical output as a function of temperature of the upper surface of the glass-ceramic cooking plate.

The temperature sensor may comprise a device whose electrical resistance changes as a function of temperature and may comprise a platinum resistance temperature detector.

The temperature sensor may be provided on, or spaced behind, the lower surface of the glass-ceramic cooking plate.

The heater may have a main heating zone at least partially surrounded by at least one additional heating zone, the main heating zone being energisable alone or together with the at least one additional heating zone. The at least one additional heating zone may be arranged against at least one side of the main heating zone, for example at opposite sides thereof. The predetermined initial time may be about 20 minutes to about 40 minutes when the main heating zone is energised together with the at least one additional heating zone, and may be about 30 minutes to about 50 minutes when the main heating zone is energised alone.

Alternatively, in particular where only a single heating zone is provided the predetermined initial time may be about 20 minutes to about 40 minutes.

The present invention enables full available power of a radiant heater to be applied for the maximum period of time, without the specified limit temperature for EN60335 being exceeded.

The settings for the predetermined initial period and the second temperature level are determined by experiment during manufacture, for each specific heater assembly, and fixedly programmed into the control means during the manufacturing process.

For a better understanding of the invention and to show more clearly how it may be carried into effect, reference will now be made, by way of example, to the accompanying drawings in which:

FIG. 1 is a diagrammatic perspective view showing a glass-ceramic cooktop appliance mounted adjacent to a back wall and a side wall;

FIG. 2 is a plan view of one embodiment of an electric heater assembly adapted for control according to the present invention;

FIG. 3 is a section along line A-A of the heater of the assembly of FIG. 2;

FIG. 5 is a graphical illustration of power levels supplied to a heater during operation of the cooking assembly of FIGS. 2 and 3;

FIG. 6 is a plan view of another embodiment of an electric heater assembly adapted for control according to the present invention;

FIG. 7 is a cross-sectional view of the heater of the assembly of FIG. 6;

FIGS. 9 and 10 are plan views of alternative embodiments of electric heaters for use in an assembly for control according to the present invention.

Figure 4:
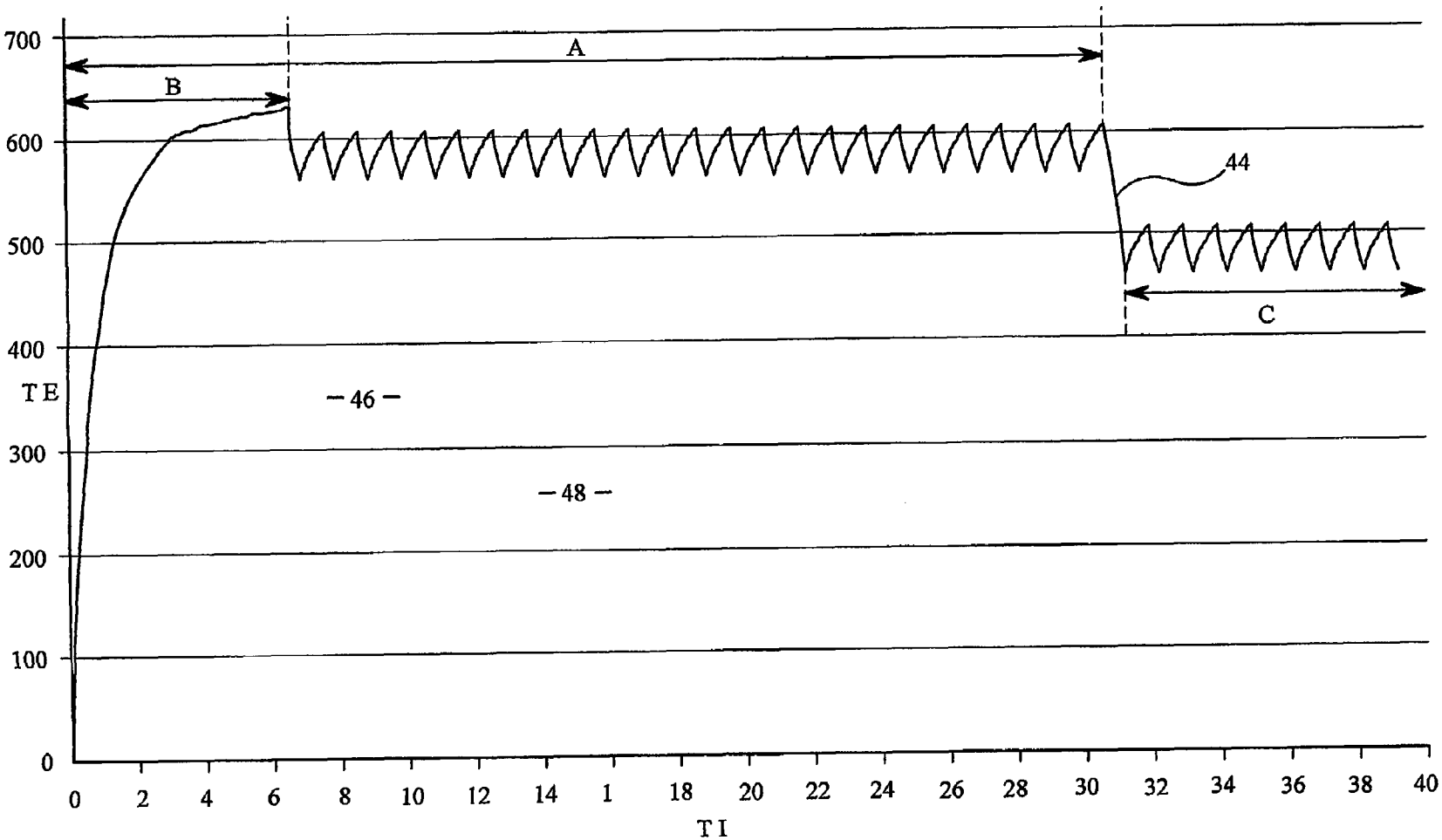
FIG. 4 is a graphical illustration of temperature of the upper surface of a cooking plate in the heating assembly of FIGS. 2 and 3, during control according to the present invention.

Referring to FIG. 1, there is shown a glass-ceramic cooktop appliance 2 mounted on a counter surface 4 adjacent to a back wall 6 and a side wall 8.

Referring to FIGS. 2 and 3, an electric heater 10 is arranged beneath a glass-ceramic cooking plate 12 in the cooking appliance 2. The heater 10 comprises a metal dish 14 having a base layer 16 of thermal insulation material, such as microporous thermal insulation material. A heating element 18 is supported on the base layer 16. As shown, the heating element 18 comprises a corrugated metal ribbon supported edgewise on the base layer 16. However, the heating element 18 could comprise other forms, such as wire or foil, or one or more infrared lamps. Any of the well-known forms of heating element, or combinations thereof, could be considered.

A peripheral wall 20 of thermal insulation material is provided, a top surface of which contacts a lower surface 22 of the glass-ceramic cooking plate 12.

A temperature sensor 24 is arranged to extend partially across the heater, between the heating element 18 and the cooking plate 12. The temperature sensor 24 comprises a tube containing a device which provides an electrical output as a function of temperature or a beam or other member carrying a device which provides an electrical output as a function of temperature. Such device may have an electrical parameter, such as electrical resistance, which changes as a function of temperature. In particular, the device comprises a platinum resistance temperature detector.

As an alternative to the temperature sensor 24, a temperature sensor could be provided deposited on, or secured in contact with, the lower surface 22 of the cooking plate 12.

A terminal block 26 is arranged at the edge of the heater and by means of which the heating element 18 is electrically connected to a power supply 28 for energising.

Control circuitry 30 is provided for the heater 10. Such control circuitry comprises a microcontroller 32, which is a microprocessor-based control unit. An energy regulator 34 is also provided, which has a control knob 36 by means of which a plurality of user-selectable energy (power level) settings of the heater 10, including a full power setting, can be achieved in known manner.

Power is supplied to the heater 10 from the power supply 28 by way of a relay 38, or by way of a solid state switch means, such as a triac.

The temperature sensor 24 is calibrated in association with the microcontroller 32 to provide an electrical output which is tuned as a function of temperature of an upper surface 40 of the cooking plate 12, which upper surface 40 is arranged to receive a cooking vessel 42.

The temperature of the glass-ceramic cooking plate 12 must not exceed a certain level in order to prevent thermal damage to the glass-ceramic material. For optimum cooking performance, it is required to be able to heat up the cooking vessel 42 and its contents as rapidly as possible, for example to achieve rapid boiling of the contents of the cooking vessel 42. Accordingly, it is desirable for the temperature of the upper surface 40 of the cooking plate 12, at which the temperature sensor 24 operates for controlling the heater 18, to be as high as permissible. However, this must not be such as to result in an unacceptably high temperature of the cooking plate 12, or an unacceptably high temperature of the back wall a limit for which is specified in European Safety Standard EN60335.

In the present invention it has been found that for a heater 10 operated in a free radiation condition at a full power level setting and controlled by way of the temperature sensor 24, such conditions can be safely maintained with the cooking plate at a first temperature level for a predetermined initial period without the temperature of the back wall 6 and side wall 8 exceeding the specified limit. It has been found that such predetermined initial period is from about 20 to about 40 minutes and is typically about 30 minutes. It has also been found that if, at the end of such predetermined initial period, the power level of the heater 10 is then reduced such that the temperature of the cooking plate is reduced from the first temperature level to a second temperature level which is between about 75 percent and 85 percent, preferably about 83 percent, of the first temperature level (corresponding to a power level of about 60 percent to about 70 percent of the power level corresponding to the first temperature level), the temperature of the back wall 6 and side wall 8 is maintained at a level which does not exceed the specified limit. The microcontroller 32 is programmed in the factory, during manufacture of the heater 10 and its associated control circuitry, with the necessary data for the predetermined initial period and the reduced temperature level. Such programmed data is thereafter automatically implemented by the microcontroller 32 to control the heater 10.

The controlling operation is illustrated in FIG. 4, which is a plot of the temperature TE in degrees Celsius of the upper surface 40 of the cooking plate 12 (known as the top glass temperature) against time TI in minutes at the full power setting. During a pre-set initial period A of 30 minutes, the heater 10 is operated at a boost power level for a period B of about 7 minutes, followed by operation at a normal full power level for a further 23 minutes. During the boost period, the temperature of the upper surface 40 of the cooking plate 12 exceeds 600 degrees Celsius and during the remainder of the predetermined initial period the temperature of the upper surface 40 of the cooking plate 12 is maintained at around 600 degrees Celsius. This enables rapid heating to boiling to take place in the cooking vessel 42. However, during this initial period A the temperature of the back wall 6 and side wall 8 does not exceed the limit specified by European Safety Standard EN60335. At the end of the period A, the microcontroller 32 automatically reduces the power level of the heater 10 to a lower fallback level such that the temperature of the cooking plate reduces to a second temperature which is about 75 to 85 percent, preferably about 83 percent, of the previous (first) temperature level. Such reduction, as denoted by reference numeral 44, can be effected in one or more steps, or continuously. During the subsequent ongoing period C, the temperature of the upper surface 40 of the cooking plate 12 is maintained at about 500 degrees Celsius and this ensures that the back wall 6 and side wall 8 are maintained at a temperature which does not exceed the specified limit. However, as shown in FIG. 4, the reduced temperature level is not such as to interfere with a temperature band 46, required for frying activities, and a temperature band 48, required for continuous boiling/simmering activities.

During normal operation, the heater 10 may be switched off, or to a lower power level setting, by a user and then back to full power while the temperature of the back wall 6 and side wall 8 is still elevated. In this case the fallback (second) temperature level requires to be re-introduced in a short time compared with the situation when the heater is first energised. In this case, the time at full (first) power (i.e., first temperature), originally set to full power, may be reduced by an amount inversely proportional to the time interval since the heater was last at full power.

Thus, for example, the time before the heater is operated at the fallback temperature level may be the initial time (e.g., 30 minutes) less half the time interval since the heater was last at full power. As a practical example, as illustrated in FIG. 5, the heater is switched to full power, and reverts to the fallback temperature level after 30 minutes as shown by point E. The heater is then switched off, or to low power, at 40 minutes as represented by point F and is subsequently switched back to full power at 50 minutes as represented by point G. In this case, the heater remains at full power for (50−30)/2 minutes, i.e. 10 minutes, before reverting to the fallback temperature level as represented by point H.

In more detail, after the heater is switched to full power from cold, for example to boil a pan of water, the power level is set by the control circuitry at the boost power level for a period of 7 minutes to provide accelerated initial heat up. At point D, the power level is reduced to normal full power, that is to the first temperature. At point E, that is after a total of 30 minutes of boost and full power, the temperature level reverts to the fallback (second) temperature level. At this temperature level, the heat output is such that the temperature of the back wall 6 and the side wall 8 will not exceed the maximum specified by EN60335, but at the same time is sufficient to maintain a significant volume of water at a fast boil or to fry. At point F, after 40 minutes of cooking the user either switches the heater off or to a lower power setting. At point G, 20 minutes after the heater was last at full power level, the user switches the heater back to full power. The control circuitry maintains the full power (first temperature) level for half of twenty minutes, i.e. for 10 minutes, and at point H, after 10 minutes at full power, the temperature level reverts to the fallback (second) temperature level.

In practice, the manner in which the time before the heater reverts to fallback temperature level is determined may be established from experimental data and could be other than a simple inverse proportionality.

Referring to FIGS. 6 and 7, an electric heater 110 is arranged beneath a glass-ceramic cooking plate 112 in a cooking appliance (not shown in detail). The heater 110 comprises a metal dish 114 having a base layer 116 of thermal insulation material, such as microporous thermal insulation material.

The heater 110 is arranged to provide two concentric heating zones. A main heating zone 118 is surrounded by an additional heating zone 120, the zones 118, 120 being separated by a dividing wall 122 of thermal insulation material, a top surface of which contacts a lower surface 124 of the glass-ceramic cooking plate 112. A peripheral wall 126 of thermal insulation material is also provided, having a top surface which contacts the lower surface 124 of the glass-ceramic cooking plate 112.

The centrally located main heating zone 118 has at least one heating element 128, supported relative to the base layer 116. The additional heating zone 120 also has at least one heating element 130, supported relative to the base layer 116. The heating elements 128, 130 are of well known form and may, for example, comprise corrugated metal ribbon elements.

A terminal block 132 is arranged at the edge of the heater 110 and by means of which the heating elements 128, 130 are electrically connected to a power supply 134 for energising.

The heating elements 128, 130 are arranged to be connected so that the heating element 128 can be operated alone, whereby the main heating zone 118 is energised alone, for heating a small cooking vessel 136A located on an upper surface 138 of the cooking plate 112. The heating element 128 can also be operated together with the heating element 130, whereby the main heating zone 118 is energised together with the additional heating zone 120, for heating a larger cooking vessel 136B located on the upper surface 138 of the cooking plate 112.

A temperature sensor 140 is arranged to extend partially across the heater, between the heating elements 128, 130 and the cooking plate 112. The temperature sensor 140 comprises a tube containing a device which provides an electrical output as a function of temperature. Such device may have an electrical parameter, such as electrical resistance, which changes as a function of temperature. In particular, the device comprises a platinum resistance temperature detector.

As an alternative to the temperature sensor 140, a temperature sensor could be provided deposited on, or secured in contact with, the lower surface 124 of the cooking plate 112.

Control circuitry 142 is provided for the heater 110. Such control circuitry comprises a microcontroller 144, which is a microprocessor-based control unit. An energy regulator 146 is also provided, which has a control knob 148 by means of which a plurality of user-selectable energy (power level) settings of the heater 110, including a full power setting, can be achieved in known manner.

Power is supplied to the heater 110 from the power supply 134 by way of a relay 150, or by way of a solid state switch means, such as a triac.

The temperature sensor 140 is calibrated in association with the microcontroller 144 to provide an electrical output which is tuned as a function of temperature of the upper surface 138 of the cooking plate 112.

The temperature of the glass-ceramic cooking plate 112 must not exceed a certain level in order to prevent thermal damage to the glass-ceramic material. For optimum cooking performance, it is required to be able to heat up the cooking vessel 136A, 136B and its contents as rapidly as possible, for example to achieve rapid boiling of the contents of the cooking vessel 136A, 136B. Accordingly, it is desirable for the temperature of the upper surface 138 of the cooking plate 112, at which the temperature sensor 140 operates for controlling the heater 110, to be as high as permissible. However, as noted previously this must not be such as to result in an unacceptably high temperature of the cooking plate 112, or an unacceptably high temperature of the back wall 6 or side wall 8, a limit for which is specified in European Safety Standard EN60335.

It has been found that for a heater 110 operated in a free radiation condition at a full temperature (power) level setting with the main heating zone 118 energised alone, and controlled by way of the temperature sensor 140, such conditions can be safely maintained at a first temperature level for a predetermined initial period without the temperature of the back wall 6 and side wall 8 exceeding the specified limit. It has been found that such predetermined initial period is from about 30 to about 50 minutes and is typically about 40 minutes. It has also been found that if, at the end of such predetermined initial period, the temperature level of the heater 110 is then reduced from the first temperature level to a second temperature level which is between about 75 percent and about 85 percent, preferably about 83 percent, of the first temperature level, the temperature of the back wall 6 and side wall 8 is maintained at a level which does not exceed the specified limit.

If the heater 110 is operated in a free radiation condition at a full temperature (power) level setting with the main heating zone 118 energised together with the additional heating zone 120, then because of the higher resulting power and the larger heated area, the temperature of the back wall 6 and side wall 8 rises more rapidly and their specified temperature limit is reached sooner than when the main heating zone is energised alone. In this case, the predetermined initial period which can be safely maintained at the first temperature level, before reducing to the second temperature level, without the temperature of the back wall 6 and side wall 8 exceeding the specified limit, is shorter and is from about 20 to about 40 minutes and is typically about 30 minutes. However, under certain circumstances the predetermined initial period can be as little as 10 minutes.

The microcontroller 144 is programmed in the factory, during manufacture of the heater 110 and its associated control circuitry, with the necessary data for the values of the predetermined initial period, according to whether the main heating zone 118 is energised alone or together with the additional heating zone 120, and also the value for the reduced second temperature level. Such programmed data is thereafter automatically implemented by the microcontroller 144 to safely control the heater 110.

Figure 8:
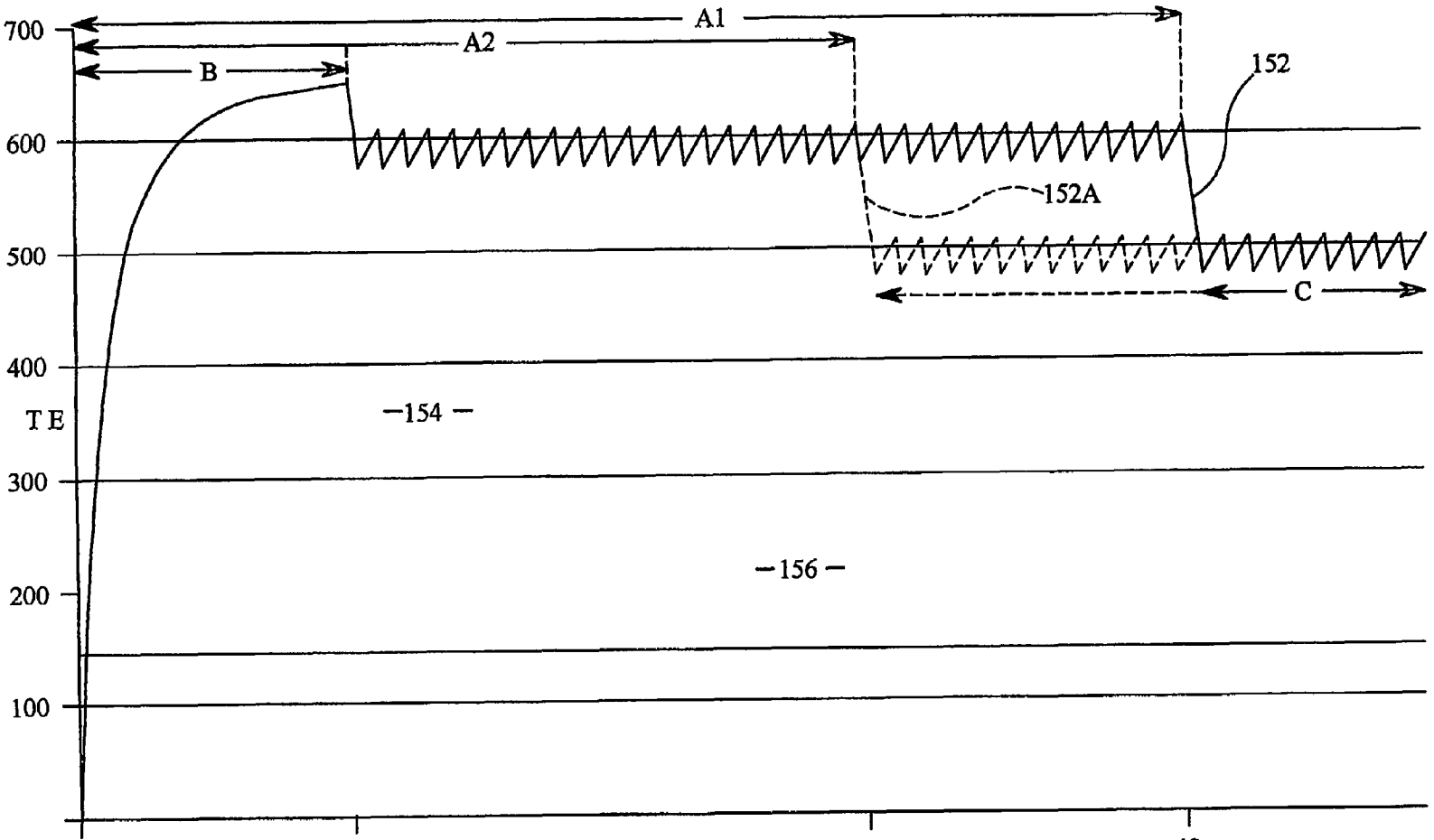
FIG. 8 is a graphical illustration of temperature of the upper surface of a cooking plate in the heating assemblies of FIGS. 6 and 7, during control according to the present invention.

The controlling operation is illustrated in FIG. 8, which is a plot of the temperature TE in degrees Celsius of the upper surface 138 of the cooking plate 112 (known as the top glass temperature) against time TI in minutes at the full power setting. With the main heating zone 118 energised alone, during a pre-set initial period A1 of 40 minutes the heater 110 is operated at a boost power level for a period B of about 7 minutes, followed by operation at a normal first temperature (full power) level for a further 33 minutes. During the boost period, the temperature of the upper surface 138 of the cooking plate 112 exceeds 600 degrees Celsius and during the remainder of the predetermined initial period A1 the temperature of the upper surface 138 of the cooking plate 112 is maintained at around 600 degrees Celsius. This enables rapid heating to boiling to take place in the cooking vessel 136A. However, during this initial period A1, the temperature of the back wall 6 and the side wall 8 does not exceed the limit specified by European Safety Standard EN60335. At the end of the period A1, the microcontroller 144 automatically reduces the temperature level of the heater 110 to a lower (second) fallback temperature level which is about 75 to 85 percent of the previous full (first) temperature level. Such reduction, as denoted by reference numeral 152, can be effected in one or more steps, or continuously. During the subsequent ongoing period C, the temperature of the upper surface 138 of the cooking plate 112 is maintained at about 500 degrees Celsius and this ensures that the back wall 6 and side wall 8 are maintained at a temperature which does not exceed the specified limit. However, as shown in FIG. 8, the reduced temperature level is not such as to interfere with a temperature band 154, required for frying activities, and a temperature band 156, required for continuous boiling/simmering activities.

When the main heating zone 118 is energised together with the additional heating zone 120, then because of the higher resulting power and increased heated area in the heater 110, the temperature of the back wall 6 and side wall 8 rises more rapidly and reaches its specified limit sooner than when the main heating zone 118 is energised alone at the boost power level followed by the normal full (first) temperature level. In this case a reduced predetermined initial period A2 of about 30 minutes is automatically implemented by the microcontroller 144 and at the end of which the temperature level is automatically reduced by the microcontroller 144 to the lower (second temperature) fallback level, as denoted by reference numeral 152A and shown by the broken line portion of the graph. This ensures that the specified limit for the temperature of the back wall 6 and side wall 8 is not exceeded, while ensuring optimised performance of the heater 110.

During normal operation, the heater 110 may be switched off, or to a lower power level setting, by a user and then back to full power while the temperature of the back wall 6 and side wall 8 is still elevated. In this case, the fallback (second) temperature level requires to be re-introduced in a short time compared with the situation when the heater is first energised. In such case, the time at full (first) temperature, originally set to full power, may be reduced by an amount inversely proportional to the time interval since the heater was last at full power.

Although FIG. 6 shows a heater 110 in which the main heating zone 118 is concentrically arranged with the additional heating zone 120, other arrangements are possible. As shown in FIG. 9 a heater 110 may comprise an oval arrangement in which the main heating zone 118, provided with heating element 128, is bordered at one side by the additional heating zone 120, provided with heating element 130. The heater 110 has a peripheral wall 126 of thermal insulation material and a dividing wall 122, also of thermal insulation material.

As shown in FIG. 10, a heater 110 may comprise what is known as an angel arrangement in which the main heating zone 118, provided with heating element 128, is bordered on opposite sides by wing-like additional heating zones 120, provided with heating elements 130. The heater 110 has a dividing wall arrangement 122 of thermal insulation material and a peripheral wall arrangement 126, also of thermal insulation material. The heaters 110 of FIGS. 9 and 10 are operated and controlled in the same way as the heater 110 of FIG. 6.

The invention claimed is:

1. A method of avoiding unacceptably high temperatures of a wall adjacent to a cooking appliance comprising:

a glass-ceramic plate (12, 112) having an upper surface for receiving a cooking vessel (42 136A, 136B) and a lower surface; a radiant electric heater (10, 110) arranged at the lower surface of the glass-ceramic cooking plate (12, 112); and electronic control apparatus including:

a temperature sensor (24, 140) for monitoring temperature at or adjacent to the cooking plate, which sensor provides an electrical output as a function of temperature; and control means (30, 142) connected to the temperature sensor and to the heater, for controlling energising of the heater from a power supply, the control means being adapted and arranged to energise the heater at a plurality of user selectable power levels including a full power level, wherein the control means (30, 142) is adapted such that, when the heater (10, 110) is energised at the full power level in order to avoid unacceptably high temperatures of a wall adjacent to the cooking appliance, the heater is energised to heat the cooking plate (12, 112) to a first temperature level for a predetermined initial period of 20 to 50 minutes and is thereafter energised automatically to heat the cooking plate to a second temperature level, lower than the first temperature level.

2. A method according to claim 1, wherein during an initial minor proportion of the predetermined initial period the heater (10, 110) is energised at a boost temperature level, in excess of the first temperature level.

3. A method according to claim 1, wherein the second temperature level is between about 75 percent and about 85 percent of the first temperature level.

4. A method according to claim 3, wherein the second temperature is about 83 percent of the first temperature level.

5. A method according to claim 1, wherein the length of the predetermined initial period is dependent on the time elapsed since the control means (30, 142) was last at the full power level.

6. A method according to claim 5, wherein the length of the predetermined initial period is inversely proportional to the time elapsed since the control means (30, 142) was last at the full power level.

7. A method according to claim 1, wherein reduction from the first temperature level to the second temperature level is effected in a continuous manner.

8. A method according to claim 1, wherein reduction from the first temperature level to the second temperature level is effected in a stepwise manner.

9. A method according to claim 8, wherein reduction from the first temperature level to the second temperature level is effected in a single step.

10. A method according to claim 8, wherein reduction from the first temperature level to the second temperature level is effected in a plurality of steps.

11. A method according to claim 1, wherein the control means (30, 142) comprises a microprocessor-based controller (32, 144) into which the predetermined initial period and a setting for the second temperature level are programmed for automatic implementation.

12. A method according to claim 1, wherein the temperature sensor (24, 140) provides an electrical output as a function of temperature of the upper surface of the glass-ceramic cooking plate (12, 112).

13. A method according to claim 1, wherein the temperature sensor (24, 140) comprises a device whose electrical resistance changes as a function of temperature.

14. A method according to claim 13, wherein the temperature sensor (24, 140) comprises a platinum resistance temperature detector.

15. A method according to claim 1, wherein the temperature sensor (24, 140) is provided on the lower surface of the glass-ceramic cooking plate (12, 112).

16. A method according to claim 1, wherein the heater (110) has a main heating zone (118) at least partly surrounded by at least one additional heating zone (120), the main heating zone being energisable in a first mode alone and in a second mode together with the at least one additional heating zone.

17. A method according to claim 16, wherein the at least one additional heating zone (120) is arranged substantially concentrically with the main heating zone (118).

18. A method according to claim 17, wherein the at least one additional heating zone (120) is arranged against at least one side of the main heating zone (118).

19. A method according to claim 18, wherein at least one additional heating zone (120) is arranged at opposite sides of the main heating zone (118).

20. A method according to claim 16, wherein the predetermined initial time is about 20 minutes to about 40 minutes when the main heating zone (118) is energised together with the at least one additional heating zone (120), and is about 30 minutes to about 50 minutes when the main heating zone (118) is energised alone.

21. A method according to claim 1, wherein the predetermined initial time is about 20 minutes to about 40 minutes.

22. A method according to claim 1, wherein the temperature sensor is spaced behind the lower surface of the glass-ceramic cooking plate.

* * * * *